US006195824B1

(12) United States Patent
Schumacher

(10) Patent No.: US 6,195,824 B1
(45) Date of Patent: Mar. 6, 2001

(54) PROCESS AND DEVICE FOR TREATMENT OF A WEB, PARTICULARLY A TEXTILE WEB

(75) Inventor: Walter Schumacher, Aachen (DE)

(73) Assignee: Eduard Kusters Maschinenfabrik GmbH & Co. KG, Krefeld (DE)

( * ) Notice: Subject to any disclaimer, the term of this patent is extended or adjusted under 35 U.S.C. 154(b) by 0 days.

(21) Appl. No.: 09/269,658

(22) PCT Filed: Aug. 8, 1997

(86) PCT No.: PCT/DE97/01685

§ 371 Date: May 25, 1999

§ 102(e) Date: May 25, 1999

(87) PCT Pub. No.: WO98/14653

PCT Pub. Date: Apr. 9, 1998

(30) Foreign Application Priority Data

Oct. 2, 1996 (DE) ..... 196 40 724

(51) Int. Cl.[7] ..... D06B 3/18
(52) U.S. Cl. ..... 8/151; 68/12.07; 68/22 R
(58) Field of Search ..... 8/151; 68/12.07, 68/22 R; 28/183; 118/665, 672

(56) References Cited

U.S. PATENT DOCUMENTS 3,207,125 9/1965 Strandberg, Jr. .
4,922,592 * 5/1990 Bongartz et al. ..... 68/22 R

FOREIGN PATENT DOCUMENTS

2613446 * 10/1977 (DE) ..... 28/183
39 25 444 2/1991 (DE) .
43 08 501 9/1994 (DE) .
411 414 2/1991 (EP) .

OTHER PUBLICATIONS

Dipl.–Ing. Kurt van Wersch, Mönchengladbach, Kontrollierte Applikation von Ausrüst–und Färbeflotten—Klein–und Hochauftrag, Vortrag anläBlich der VÖTC–Jahrestagung am Sep. 23, 1988, Dornbirn.*

Peter, Max: Grundlagen der Textilveredlung/von M. Peter. 12., neu überarb.u.erw. Aufl.—Frankfurt/M.: Deutscher Fachverlag, 1985.*

* cited by examiner

*Primary Examiner*—Philip R. Coe
(74) *Attorney, Agent, or Firm*—Kenyon & Kenyon

(57) ABSTRACT

A process for dyeing a textile web, in which the textile web is continuously guided through a trough that contains the dye bath, and subsequently passes through a pair of squeezing rollers. The line force of the pair of squeezing rollers is adjusted as a function of the length of textile web (L) that has passed through, with the aim of achieving a uniform amount of dye applied over the length of the textile web, per surface unit of the textile web.

15 Claims, 3 Drawing Sheets

PROCESS AND DEVICE FOR TREATMENT OF A WEB, PARTICULARLY A TEXTILE WEB

BACKGROUND OF THE INVENTION

The present invention relates to processes and apparatus for treating a textile web with a treatment liquid containing a treatment medium, such as a dye bath, in which the textile web is continuously guided through a trough containing the treatment liquid, and subsequently passed through a pair of squeezing rollers.

One such process and corresponding apparatus are known from the reference "Melliand Textilberichte" 1/1989, pages 46 to 52, particularly page 52, FIG. 23. The trough and the pair of squeezing rollers together form a conventional foulard. In the known embodiment, a system for "concentration regulation," shown schematically, can be seen in the trough of the foulard, which is supposed to be able to take place "locally (edge/center) and/or laterally (run-off/tailing)." However, there is no information in the reference to indicate what is to be done with the concentration values that are determined. The pair of squeezing rollers of the foulard is entirely neutral, i.e. it is shown without any reference to a control mechanism.

The present invention begins from consideration of problems in the continuous dyeing of textile webs on a foulard. In this connection, particularly in the case of substantive and reactive dyes, the effect occurs that water, as the solution and transport medium, is absorbed more slowly or more rapidly by the web as it passes through the trough of the foulard, relative to the dye components in the dye bath. If the web absorbs water more rapidly, the dye bath loses water and the concentration of dye becomes higher. This means that the depth of shade increases, i.e. that the beginning of the web is clearly dyed a lighter color than the end of the dye lot in question.

A typical example for this case is dyeing viscose with reactive dyes. Initially, viscose swells very much and entrains a lot of water from the dye bath.

However, the reverse case also occurs, that a certain textile web absorbs more dye from the dye bath. This means that the beginning of the dye lot is dyed with a greater depth of shade.

When dyeing with reactive dyes, another cause for a nonuniform dye result over the length of the web is the tendency of reactive dyes to hydrolyze. Hydrolyzed reactive dye is no longer available for the actual dyeing process, and can therefore lead to concentration changes of reactive reactive dyes.

Color changes over the length of the web are also referred to as "tailing." As a rule, they proceed according to a positive or negative e function and end in a state of equilibrium; after this equilibrium is reached, no further changes take place. Changes over the length of the web can be influenced not only by the properties of the fiber material, but also by physical properties such as strong water absorption of the web and swelling processes.

Although the causes of tailing are essentially known today, the problem continues to exist in practice and the initial lengths of some dye lots still have to be sold as seconds or have to be rejected entirely. The solution approaches tried until now have not been very successful. These solution approaches were, for example, to use dyes with a low affinity and/or hydrolysis constant, to reduce the temperature in the dye trough, or also to minimize the bath content in the dye trough.

In many cases, all these solution approaches reach clear limits, particularly in the important case of dyeing viscose with reactive dyes, which was mentioned, where starting lengths on the order of several tens of meters show color deviations which result in spoilage. Since shorter and shorter lengths of dye lots are being demanded today (down to as little as a hundred meters), there clearly is an urgent need to address this problem. The several tens of meters of starting length which cannot be used represent too high a proportion of damaged goods.

SUMMARY OF THE INVENTION

The present invention is directed to the task of providing a process and apparatus for treating a textile web with a treatment liquid containing a treatment medium such that the problem of tailings is avoided, or at least reduced.

A central idea in this invention is to balance out the change in concentration of the dye bath which takes place in the foulard trough at the beginning of the pass of a dye lot, by controlling the application amount of the dye bath. If the concentration in the foulard basin increases, the squeezing rollers are set to impinge more strongly upon the web, thereby reducing the amount of treatment liquid which remains on the textile web. This counteracts an overly great depth of shade. Vice versa, if the concentration of treatment medium in the foulard trough drops, the application amount is increased by a corresponding adjustment of the pair of squeezing rollers, in order to keep the depth of shade at the desired value.

The invention works in two steps. First, a test textile web length is allowed to pass through at a line force of the pair of squeezing rollers that is kept constant, in order to determine the concentration progression in the trough over the length of the textile web. The relationship between a concentration change and the line force change required to balance it out is determined in advance, either by calculations or by experiments, and is stored in memory in the regulation device. If the concentration of treatment medium in the trough drops after the first segment of the textile web has passed through, the line force is reduced by a certain amount, so that more treatment liquid and therefore also more treatment medium remains on the textile web, in order to balance out the concentration drop in the treatment liquid. The same holds true analogously if the concentration of the bath in the trough initially increases. This concentration progression and the resulting reference progression in the line force over the textile web length which is required to balance it out, in order to apply a uniform amount of treatment medium to the textile web, are stored in memory. When the subsequent production textile web length(s) now pass(es) through, the line force progression over the length of the textile web is regulated to the reference progression stored in memory. The determination of the concentration progression only has to be made once for a specific fabric, a specific treatment liquid, and specific other treatment parameters such as temperature and working speed. All other lots can be treated using the results stored in memory.

The result, in other words the reference progression, can remain stored in memory in the device, if the test run and the subsequent production runs all take place on the same device.

An arrangement for amount-controlled application of sizing to a textile web is known from U.S. Pat. No. 3,207,125 (the contents of which are incorporated herein by reference), which also works with a foulard-type application device, and contains a trough for saturating the textile web with the sizing and a pair of squeezing rollers provided directly afterwards, to adjust the amount of liquid applied. The electrical resistance at the textile web is continuously measured on a length segment between the pair of squeezing rollers and a measurement roll. The electrical resistance in the web depends on the specific conductivity of the bath and the amount of bath applied. If the influence of a changing conductivity can be eliminated, the measured resistance value is a measure for the amount applied, and therefore of the amount of sizing applied per surface unit. In order to eliminate the influence of changes in the conductivity of the bath, the conductivity is measured in the trough, on a random sample basis, and if deviations occur, the resistance signal between the pair of squeezing rollers and the measurement roll is adjusted. The conductivity measurements in the trough therefore serve only to check the bath properties, not to control the line force of the pair of squeezing rollers. This control takes place rather via the resistance of the length segment of the web in the measurement section, where a change means a change in the amount applied. If a deviation from the predetermined reference value occurs, the amount of liquid applied is subsequently adjusted by setting the line force of the pair of squeezing rollers.

Control of the line force of the pair of squeezing rollers of a foulard is known from European Patent 411 414 B1. However, here control takes place as a function of the calorimetrically determined color of the textile web, which is still damp, after it leaves the pair of squeezing rollers.

Another aspect of the invention is to determine the reference curve independent of the production site, in a laboratory or technical-scale facility, and to record it on a data medium that is made available, for example, in the form of a card for a certain material of the textile web or a certain treatment of the web, and handed over to the finisher. The finisher then only has to insert the data medium into his/her control device and can run the lot without having to determine the concentration progression of the initial length in advance and having to determine the reference curve for the line force over the length of the textile web. In particular, the data medium can be easily duplicated and made available for use at several production sites.

In another embodiment of the invention, the concentration change in the trough of the foulard as the textile web passes through is still taken into account. However, this is not done in regulated manner, but rather according to a fixed, predetermined progression. In other words, the concentration changes which occur on certain textile webs during certain treatments are taken into account in simplified form, on the basis of empirical data.

The line force progression over the length of the textile web can only approximate the "theoretical" line force progression resulting from the actual concentration change in the trough, but practice has shown that approximations can be found that eliminate the deviations of the treatment result from the ideal value, in other words the color deviations, for example, to such an extent that in practice, for example using the eye, no differences can be determined.

The theoretical line force progression over the length of the web is approximated in linear manner, or in linear manner piece by piece, because this type of control is the easiest to implement.

BRIEF DESCRIPTION OF THE DRAWINGS

Several embodiments of the invention are shown in the drawings, in schematic form, in which.

DETAILED DESCRIPTION OF THE INVENTION

Figure 1:
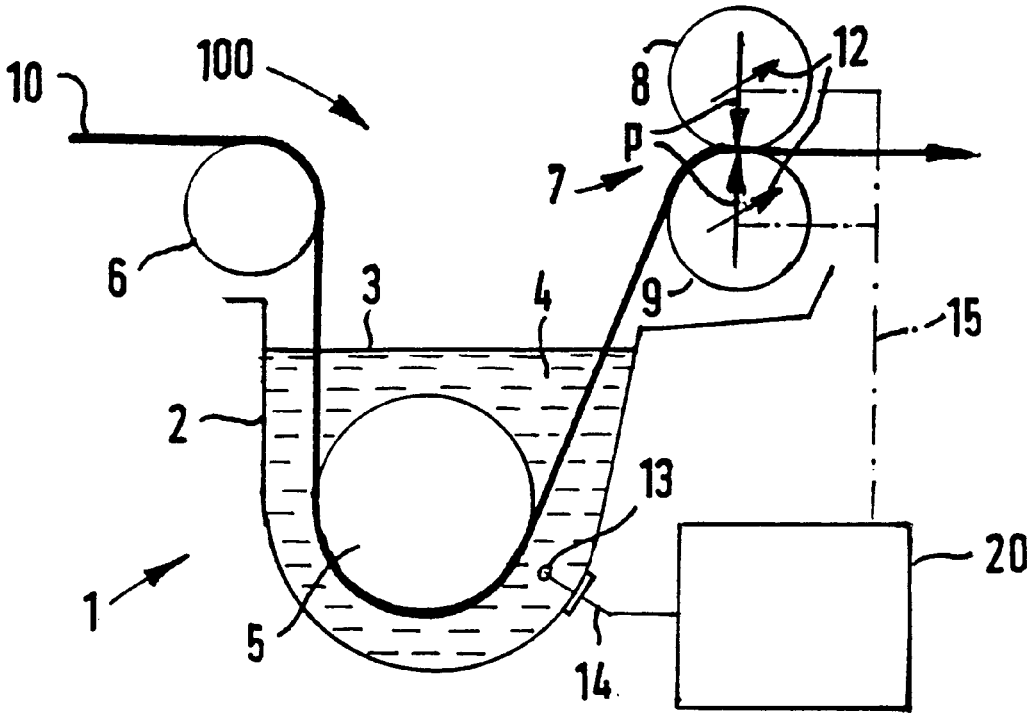
FIG. 1 shows a schematic side view of a foulard which can be controlled on the basis of concentration.

FIG. 1 shows a device, designated as a whole as 100, for dyeing a textile web 10, for example a lining or blouse material made of viscose, using reactive dyes, which works independently of the length of the textile web 10 that has passed through, only as a function of the concentration of the bath. Device 100 includes a foulard 1, which contains a trough 2, in the usual manner, which is filled up to a bath surface 3 with dye bath 4, which represents the treatment liquid. The treatment medium is the dye contained in the treatment liquid, in an amount proportional to the amount of liquid. A rotating deflection roller 5 is arranged in trough 2, located entirely below bath surface 3. Above bath surface 3, on the right, outside trough 2, a pair of squeezing rollers, designated as a whole as 7, is provided, composed of a top roller 8 and a bottom roller 9, which is also part of foulard 1. In the exemplary embodiment, rollers 8, 9 are deflection-controlled rollers. Textile web 10 is guided from top to bottom, via a deflection roller 6 arranged above bath surface 3 on the left side of trough 2 in FIG. 1, runs down into the dye bath, is deflected by 180° by deflection roller 5, and leaves dye bath 4, going up, and then immediately passes through the pair of squeezing rollers 7. Rollers 8, 9 of the pair of squeezing rollers 7 exert a line force p per length unit of rollers 8, 9, which is represented by arrows indicated with p. The effect of passing through the pair of squeezing rollers 7 is that the textile web 10 has had the water removed from it, down to a certain moisture content, corresponding to a certain application of dye to textile web 10, i.e. a certain amount of dye per surface unit of textile web 10.

The line force is understood to be the total force per cm of roller length exerted by rollers 8, 9 in the roll nip. The resulting line pressure in the roll nip depends on the width of the roll nip in the direction of movement of the textile web. The line pressure is different at every location of the roll nip, seen in the direction of movement of the textile web, and has an approximately parabola-shaped progression, with the maximum in the center.

The line force of pair of squeezing rollers 7 can be changed as textile web 10 passes through, as indicated by the small crosswise arrows 12. Here, the change as a function of the textile web length is relevant. The line force profile in the direction of the textile web width is not of interest. It is selected in such a way that the moisture becomes as constant as possible in the direction of the textile web width. When speaking of "the" line force, this means an average value over the width of the textile web. It is therefore supposed to be possible to adjust this average value in variable manner over the length of textile web 10, in order to achieve uniform dye application to textile web 10 in the lengthwise direction.

At the beginning of a lot, there is a certain amount of dye bath 4 in trough 2. The concentration of treatment medium, i.e. of dye, in this dye bath is determined continuously in some suitable manner, using a measurement device 13, which is constantly connected with a regulation device 20, via a measurement line 14. This regulation device 20 controls the amount of the mean linear force of pair of squeezing rollers 7, as a function of the signal of measurement device 13, as indicated by the dot-dash connecting line 15.

When a lot starts to pass through device 100 and the concentration of the dye in dye bath 4 changes, as determined by measurement device 13 (e.g. optically), regulation and control device 20 sets a different line force of pair of squeezing rollers 7, according to a predetermined algorithm, i.e. a calculated algorithm or an algorithm experimentally determined in a test run, which establishes a relationship between a concentration change that occurs at a certain concentration and the line force change which is necessary to maintain the amount of dye applied to textile web 10. If, for example, the concentration drops, the line force is also lowered, so that more dye bath and therefore more dye remains on textile web 10, once it has left pair of squeezing rollers 7. The goal is to keep the amount of dye applied to textile web 10 per surface unit of textile web 10 constant, in spite of concentration changes of dye bath 4 in trough 2.

Figure 2:
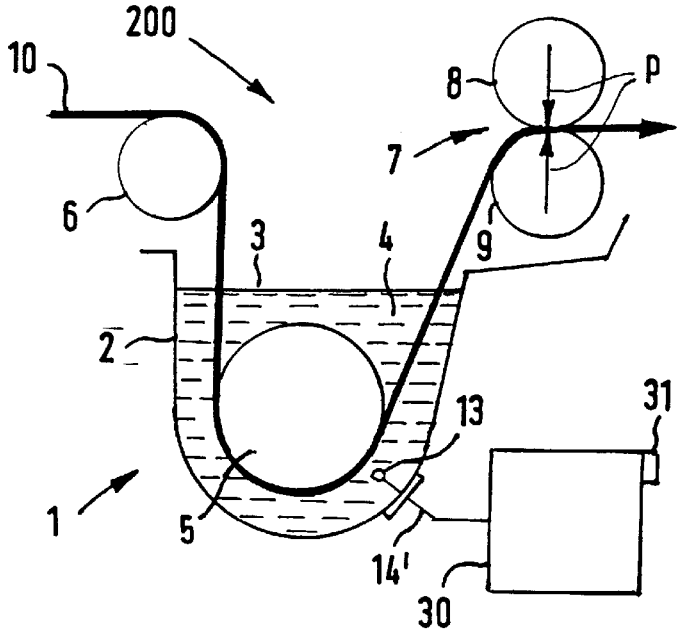
FIG. 2 and 3 show corresponding views for implementing a first exemplary embodiment of the invention.
Figure 3:
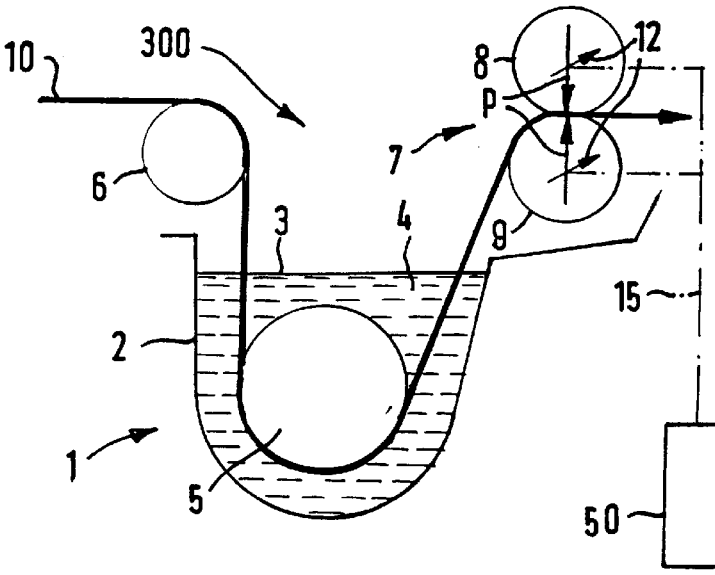
Figure 3A:
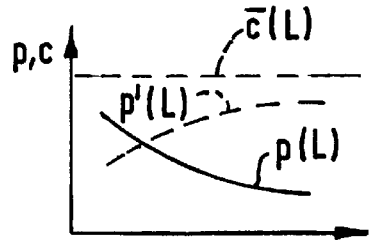

FIG. 2 to 3*a* show a process in which the adjustement of pair of squeezing rollers 7 is made dependent on the length of textile web that has passed through. Device 200 of FIG. 2 agrees with device 100 of FIG. 1 with regard to foulard 1, and therefore has the same reference numbers in this regard. According to FIG. 2, measurement device 13 is connected with a recording device 30, which detects the progression of the concentration of dye bath 4 as a function of the length of textile web that has passed through, via a line 14', and records it on a data medium 40, which can be removed from recording device 30 at an output device 31, once the lot has passed through.

On a first segment of a textile web 10 of a certain material, with a specific dye bath 4, a specific temperature and working speed, the concentration progression over the length of the segment is measured, where the line force is kept constant in pair of squeezing rollers 7, as indicated by the absence of crosswise arrows 12 (see FIG. 1) in FIG. 2.

Figure 2A:
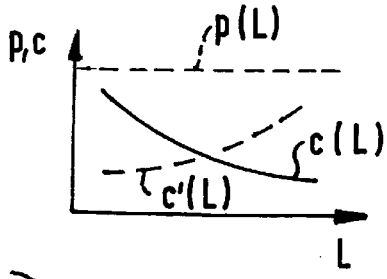
FIG. 2*a* and 3*a* show related diagrams.

Then, a relationship according to FIG. 2*a* is obtained over length L of the textile web that has passed through. Here, the line force p, on the one hand, and the concentration c(L) in the trough (2), on the other hand, are entered on the ordinate, while the length L of the textile web that has passed through is entered on the abscissa. The line force p(L) is constant. However, the concentration of dye bath 4 in trough 2 changes. In the exemplary embodiment shown with solid lines, it is assumed that textile web 10 extracts the dye more in the initial phase, so that the dye concentration drops over length L. The opposite progression is also possible, however, so that c'(L) increases, as shown in FIG. 2*a* with a broken line.

The concentration progression c(L) is converted, in recording device 30, using a predetermined algorithm, into a reference progression of the line force p(L), which is suitable for balancing out the difference in the amount of dye applied to textile web 10 which can be expected due to the concentration change, i.e. for assuring a uniform applied amount.

The reference progression p(L) of the line force is stored in memory in recording device 30, on a data medium 40, which can be removed at 31 after the lot has passed through, and duplicated if necessary. The drawing is to be understood as a schematic drawing. In practice, creation of data medium 40 can also be done in a different way.

The measurement using a test lot at constant line pressure as described above, and the determination of the reference progression, can be carried out in a laboratory or in a technical-scale facility, outside of the finishing company. The reference progression p(L) recorded on data medium 40 holds true for all instances of a specific material of textile web 10, a specific dye bath, and specific treatment parameters.

A finishing company has a device 300 according to FIG. 3, which agrees with device 100 in terms of foulard 1, i.e. contains a pair of squeezing rollers 7 with an adjustable line force p. 200 and 300 can also be one and the same device, if measuring of the test lot and production take place at the same location. The line force is then merely kept constant during recording of the reference progression.

In the exemplary embodiment shown, measurement device 13 is not present in device 300. Of course it can be present but simply not used.

Device 300 contains a regulation device 50 for regulating the line force progression over the textile web length in accordance with the reference progression determined according to FIG. 2 and stored on data medium 40. Regulation device 50 is connected with the two rollers 8, 9 of pair of squeezing rollers 7, via line 15, which can be used to pass signals to change line force p to rollers 8, 9. Regulation device 50 has an input device 51, into which data medium 40 can be inserted. On the basis of the data stored on data medium 40, the line force progression of pair of squeezing rollers 7 is regulated along the reference progression, in such a way that the amount of treatment medium, i.e. dye applied to textile web 10 after it leaves pair of squeezing rollers 7 remains constant over the length of textile web 10.

These relationships are reproduced in the diagram of FIG. 3*a*. Concentration c(L) of treatment medium, i.e. dye on textile web 10 is constant over length L of the textile web that has passed through. Reference progression p(L) of the line pressure drops in the assumed exemplary embodiment, in which concentration c(L) in trough 2 also drops. In the other case, that is if the concentration in the trough increases, the broken-line progression p'(L) is maintained. This is handled in such a way that the reference progression is determined once for every fabric and for a certain treatment of such fabric. Whenever a new lot of the same material is to be dyed under the same conditions, data medium 40 is brought out and used to regulate device 300. This can be done at a different location than the location at which data medium 40 was created, and, if data medium 40 has been duplicated, even at several locations at the same time.

Figure 4:
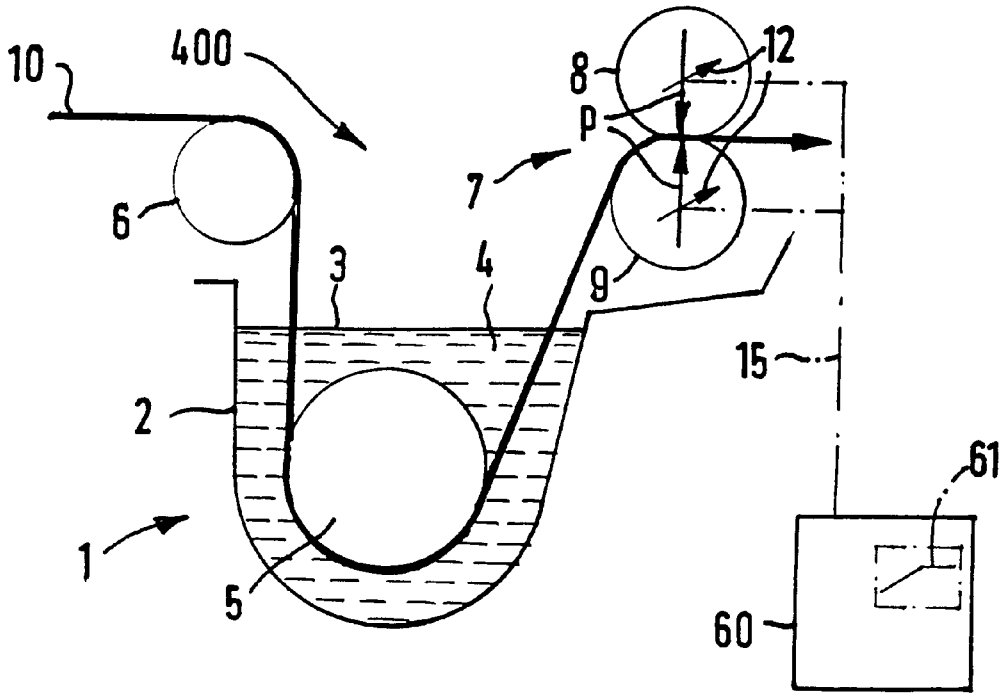
FIG. 4 shows a view of a second embodiment of the invention, corresponding to FIG. 1.
Figure 4A:
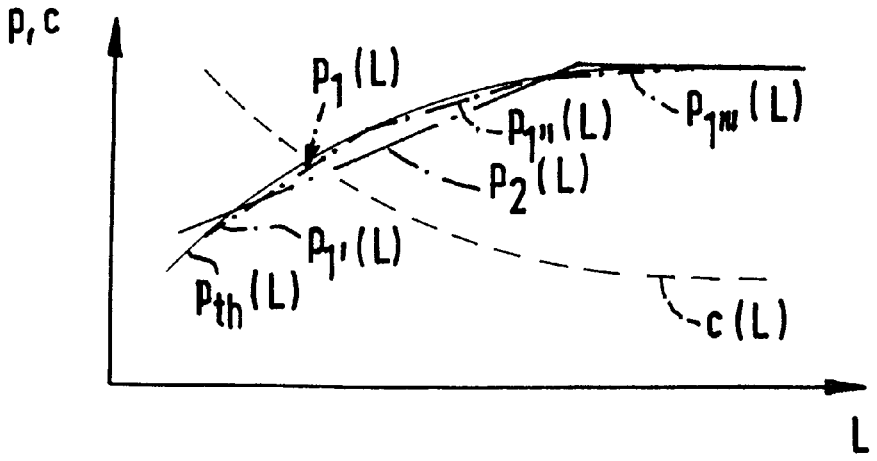
FIG. 4*a* shows a corresponding diagram.

Device 400 of FIG. 4*a* also corresponds, as far as the foulard is concerned, to the one in FIG. 1, and has the same reference numbers where this applies. Foulard 1 contains a pair of squeezing rollers 7, at which line force p can be adjusted in accordance with arrows 12.

There is no measurement device on trough 2. Instead, the progression of line force p over length L of textile web 10 is controlled, instead, according to a predetermined length function. The control device is indicated with 60. Here, the progression of line force p over the length of the textile web is predetermined in some form, as reproduced by curve 61 reproduced in the small dot-dash rectangle. In the exemplary embodiment, the line force therefore increases in linear manner, and then assumes a stationary value. This holds true for the case that the concentration of dye bath 4 in trough 2 increases at first, as the lot passes through, i.e. for the case that the fabric tends to absorb more water, due to swelling or the like. In the opposite case, the line force would have to be lowered over the initial length of the lot.

The relationships are reproduced again in FIG. 4*a*, in the form of a diagram, which shows the progression of line force p, on the one hand, and concentration c of dye in the treatment liquid in trough 2, on the other hand, over length L of the textile web that has passed through.

The case where concentration c, shown with a broken line, in trough 2 decreases over length L of the textile web that has passed through, is shown.

In order to balance this out exactly, i.e. to achieve a constant amount of dye applied per surface unit on textile web 10, in spite of this drop in trough 2, the line pressure would have to progress according to curve $p_{th}(L)$, shown with a thin line.

This theoretical curve $p_{th}(L)$ is not regulated, however, but rather approximated with a control mechanism.

Curve $p_1(L)$ represents an approximation of the rising part of curve $p_{th}(L)$ in three linear pieces $p_{1'}(L)$, $p_{1''}(L)$, and $p_{1'''}(L)$. Subsequently, curves $p_{th}(L)$ and $p_1(L)$ make a transition into a constant line force over length L.

Practice has shown, however, that in many cases an approximation of the rising part of curve $p_{th}(L)$ is possible with a single linear segment, which is reproduced by curve $p_2(L)$.

Experience has shown that differences of five percent in the amount of dye applied to the textile web can be detected using measurement technology, but are no longer perceived by the naked eye. As long as curves $p_1(L)$ and/or $p_2(L)$ do not deviate from the ideal curve $p_{th}(L)$ by more than five percent, this approximation is adequate in practice.

The selection of the incline and the location of the linear approximation progressions are determined from empirical values.

What is claimed is:

1. A process for treatment of a textile web with a treatment liquid containing a treatment medium, in which the textile web is continuously guided through a trough which contains the treatment liquid, and subsequently passes through a pair of squeezing rollers, comprising the steps of:

using a test textile web to measure the concentration progression of the treatment liquid in the trough at a constant line force of the pair of squeezing rollers, as a function of the length of textile web that has passed through;

using this information to determine a reference progression of the line force over the length of textile web that has passed through, using a previously determined relationship between a concentration change in the trough and the line force change of the pair of squeezing rollers necessary to balance it out, in such a way that the amount of applied treatment medium per surface unit of the textile web remains constant over the length of the textile web;

treating a length of production textile web that is made of the same material, using the same treatment liquid and under the same treatment parameters, wherein when the treatment liquid is applied to the length of textile web, the line force of the pair of squeezing rollers is regulated on the basis of the reference progression.

2. The process according to claim 1, wherein the reference progression of the line force for a specific textile web and a specific treatment liquid under specific treatment parameters is recorded on a data medium as the test textile web passes through, which is available to regulate the line force progression of the pair of squeezing rollers in the treatment of production textile webs.

3. A device for treatment of a textile web with a treatment liquid, comprising:

a trough for containing the treatment liquid, through which the textile web can be passed continuously over its length;

a pair of squeezing rollers located outside of the area of the trough that contains the treatment liquid, the squeezing rollers having an adjustable line pressure through which the textile web can be passed after it leaves the treatment liquid in the trough;

a measurement device for measuring the concentration of the treatment liquid in the trough;

a recording device, connected with the measurement device for recording a reference progression of the line force of the pair of squeezing rollers from the concentration progression in the trough as the textile web passes through at a constant force of the pair of squeezing rollers, taking the relationship into account;

a memory device for storing this relationship between a concentration change in the trough and the line force change of the pair of squeezing roller required to balance it out; and a regulation device that is not connected to the measurement device, by which the line force of the pair of squeezing rollers can be adjusted as a function of the relationship stored in the memory device;

wherein the line force can be regulated over the length of the textile web, as a function of the reference progression stored in memory, using the regulation device.

4. The device according to claim 3, wherein the recording device stores the measured concentration progression on a data medium, which can be output by the recording device and input into the regulation device and read by the latter.

5. A process for treatment of a textile web with a treatment liquid containing a treatment medium, comprising the steps of:

continuously guiding the textile web through a trough which contains treatment liquid;

subsequently passing the textile web through a pair of squeezing rollers that exert a line force on the textile web that is controlled as a function of the length of textile web that has passed through the rollers, so as to provide a uniform amount of treatment medium applied over the length of the textile web, per surface unit of the textile web; and wherein the theoretical line force progressions ($p_{th}(L)$) over the length of the textile web, which would have to be maintained on the basis of the concentration progression in the trough containing the treatment liquid, with the goal of uniform application of the treatment medium per surface unit of the textile web, is approximated by the control.

6. The process according to claim 5, wherein the theoretical line force progression ($p_{th}(L)$) is approximated in linear or piece-by-piece linear manner.

7. A device for treatment of a textile web with a treatment liquid, comprising:

a trough for containing treatment liquid, through which the textile web can be passed continuously over its length;

a pair of squeezing rollers arranged outside of the treatment liquid located in the trough, said squeezing rollers being arranged to exert an adjustable line pressure through which the textile web can be passed after it leaves the treatment liquid in the trough; and a control device, by which the line force (p) of the pair of squeezing rollers can be controlled over the length of the textile web (L), according to a predetermined progression;

wherein the theoretical line force progression ($p_{th}(L)$) over the length of the textile web (L), which would have to be maintained on the basis of the concentration progression in the trough containing the treatment liquid in order to provide a uniform application of the treatment medium per surface unit of the textile web over the length of the textile web (L), is approximated by the control device.

8. The device according to claim 7, Wherein the theoretical line force progression ($p_{th}(L)$) is approximated in linear or piece-by-piece linear manner.

9. An apparatus for treatment of a textile web with a treatment liquid, comprising:

a first treatment station, comprising:

a trough for containing the treatment liquid, through which a test length of textile web can be passed continuously over its length;

a pair of squeezing rollers located outside of the area of the trough that contains the treatment liquid, the squeezing rollers having an adjustable line pressure through which the test length of textile web can be passed after it leaves the treatment liquid in the trough;

a measurement device for measuring the concentration of the treatment liquid in the trough;

means for using measurements provided by the measurement device to determine a function which determines that variation in spacing between the squeezing rollers which provides a uniform degree of application of treatment to a length of textile web;

means for recording this function in a memory medium;

a second treatment station, comprising:

a trough for containing the treatment liquid, through which a length of production textile web can be passed continuously over its length;

a pair of squeezing rollers located outside of the area of the trough that contains the treatment liquid, the squeezing rollers having an adjustable line pressure through which the production textile web can be passed after it leaves the treatment liquid in the trough;

a memory reader for reading the function from the memory medium; and a regulation device that is controlled by the function so read so as to alter the spacing between the rollers, and thereby provide an even level of treatment across the length of the production textile web.

10. The device as set forth in claim 9, wherein one treatment station can serve as the first treatment station at a first time, and as the second treatment station at a different time.

11. The process as set forth in claim 1, wherein the treatment medium is a dye bath.

12. The device as set forth in claim 3, wherein the treatment medium is a dye bath.

13. The process as set forth in claim 5, wherein the treatment medium is a dye bath.

14. The device as set forth in claim 7, wherein the treatment medium is a dye bath.

15. The apparatus as set forth in claim 9, wherein the treatment medium is a dye bath.

* * * * *